United States Patent [19]

Batten

[11] Patent Number: 4,538,483

[45] Date of Patent: Sep. 3, 1985

[54] FASTENER WRENCHING MEANS

[75] Inventor: Ronald W. Batten, Torrance, Calif.

[73] Assignee: V.S.I. Corporation, Pasadena, Calif.

[21] Appl. No.: 514,783

[22] Filed: Jul. 18, 1983

[51] Int. Cl.[3] ..... B25B 17/00

[52] U.S. Cl. ..... 81/56; 81/57.14; 81/57.3

[58] Field of Search ..... 81/55, 56, 57.14, 57.3, 81/436, 460, 461; 403/328, 322, DIG. 8

[56] References Cited

U.S. PATENT DOCUMENTS

| | | | |
|---|---|---|---|
| 2,239,072 | 4/1941 | Adams | 81/55 |
| 2,726,091 | 12/1955 | Topar | 81/436 |
| 3,584,527 | 6/1971 | Bosten | 81/56 |
| 4,289,414 | 9/1981 | Recker | 403/328 |

FOREIGN PATENT DOCUMENTS

| | | | |
|---|---|---|---|
| 2345454 | 9/1973 | Fed. Rep. of Germany | 81/436 |

*Primary Examiner*—James L. Jones, Jr.
*Attorney, Agent, or Firm*—Robert E. Strauss

[57] ABSTRACT

There is disclosed an improved power assisted wrenching tool for the attachment of fasteners in loose and interference fit applications, and particularly for use with frangible fasteners. The improvement comprises a readily removable key which is used to immobilize the bolt during attachment of a threaded fastener, typically in a loose fit application. The key is retained in a wrenching tool assembly by a detent ball which is positively locked in the center core of the holder member of the wrenching tool and can only be disengaged by the axial alignment of the holder and the socket drive members of this assembly. The tool is thus easily adaptable for the application of fasteners in either loose or interference fit applications.

24 Claims, 12 Drawing Figures

FASTENER WRENCHING MEANS

BACKGROUND OF THE INVENTION

1. Field of Invention

This invention relates to a power assisted wrenching tool and, in particular, to a wrenching tool for attachment of fasteners in loose and interference fit applications.

2. Brief Statement of the Prior Art

Threaded fasteners are frequently used in loose fit applications in which it is difficult to work from both sides of the workpiece. This occurs quite frequently In the aerospace industry, and a particular fastening system has been developed in this industry. This system employs frangible fasteners comprising a bolt with a threaded nut member having a threaded collar and a distal wrenching ring separated by a notched section that provides a predetermined limiting torque which when exceeded, permits the wrenching ring to shear from the threaded collar, leaving the latter in place at a precise, predetermined tensile loading on the bolt member. Often, the threaded collar has an upset portion, usually a slightly elliptical shape, to provide a frictional spring lock to prevent the fastener from spinning off in the event that the residual tension on the fastener is lost. Typically, these fasteners are used both in loose and interference fit applications, and in the former applications it has been the practice to use a drive tool having a center key which is inserted into a broached keyway of the bolt to hold the bolt stationary while the threaded collar is applied.

Typically, the key is mounted in a keyway broached in the center core of a key holder member of the wrenching tool. The holder member is slideably received in a central through bore of the driven, socket member. The key is fixedly secured in the core of the holder member usually by a set screw. This attachment is cumbersome and causes delays and difficulties in changing the tool from the application of fasteners in interference fit and loose fit applications, since in only the latter is the key necessary. Also, the key often breaks during use and it is necessary to replace broken and worn keys, again a time consuming operation with the customary set screw lock. occasionally, the key becomes jammed in a bolt during the application of a threaded fastener and, when this occurs, the tool is immobilized and difficulties are experienced in removing the tool from the work.

BRIEF DESCRIPTION OF THE INVENTION

This invention comprises a readily removable key in combination with a wrenching tool for threaded fasteners, preferably for use with frangible fasteners, although the tool is equally useful with non-frangible fastener systems. The wrenching tool comprises a driven member having a distal socket and a central through bore which slideably receives the core of a holder member. The latter has a center bore, which is broached to provide a hexagonal keyway to receive a hexagonally flatted key. The key of this invention has a distal groove and is restrained in the core member by a detent ball. A cross bore is provided in the core of the holder member, intersecting the center keyway and the ball is captured in this cross bore. The ball has a sufficient diameter that it must be laterally displaced from the groove of the key to permit the latter to be extracted from the core of the holder. An annular groove is provided about the center through bore of the driven socket member at a predetermined, intermediate distance along its length, thereby providing a laterally offset recess which, when aligned with the cross bore of the holder member, will permit the ball to shift laterally outwardly, releasing the key. In other, non-aligned positions, the ball is securely retained in the distal groove of the key, thereby restraining the latter.

BRIEF DESCRIPTION OF THE DRAWINGS

The invention will be described with reference to the figures of which.

DESCRIPTION OF THE PREFERRED EMBODIMENT

Figure 1:
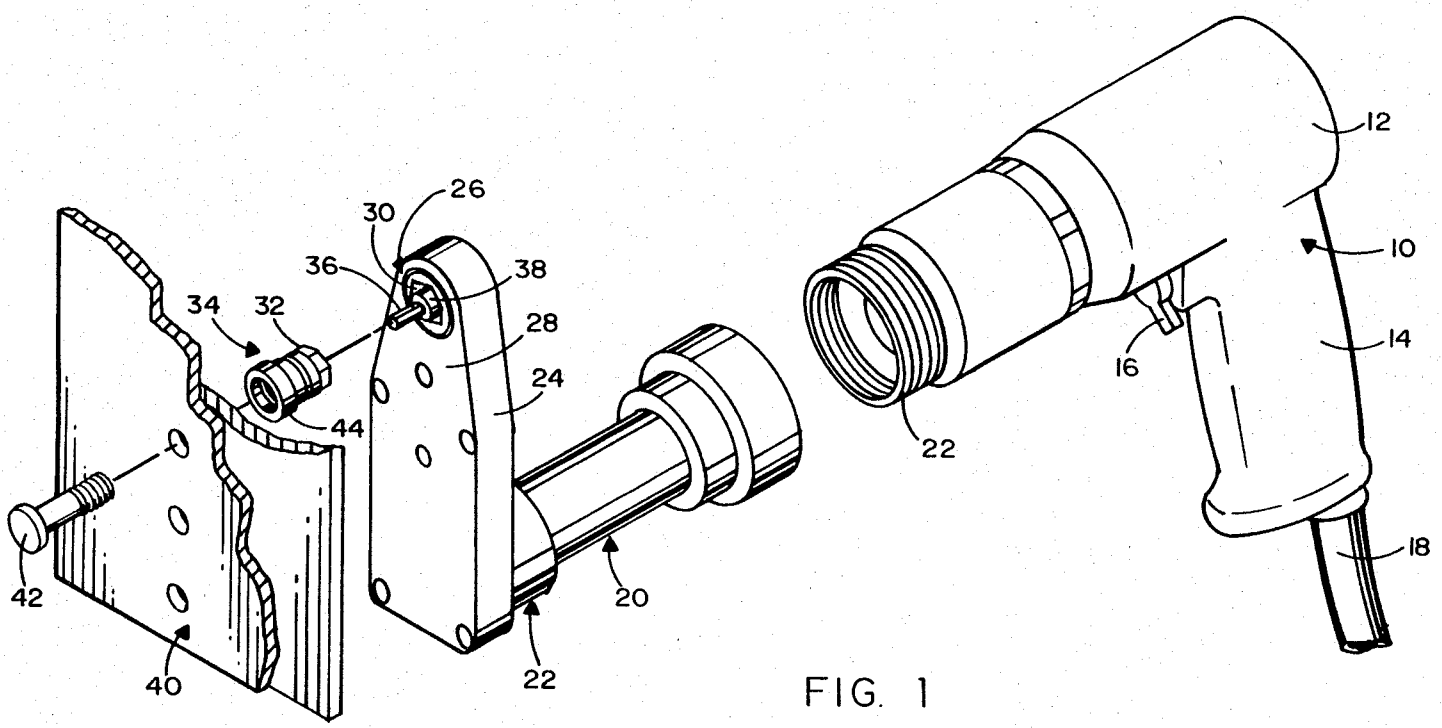
FIG. 1 is an exploded perspective view of the wrenching tool.

Referring now to FIG. 1, the invention is shown as employed in a otherwise conventional wrenching tool. The wrenching tool includes a motor assembly 10 with a motor housing 12 and a integral, dependent hand grip 14 having a trigger 16. The motor assembly 10 is supplied with a motive fluid, commonly compressed air, through a flexible hose 18. The particularly illustrated wrenching tool includes a torque control assembly 20 which is threadably engaged on the threaded boss 22 of the housing 12 and which has an internal shaft, not shown, that is connected to the motor drive shaft. The torque control assembly 20 contains an internal friction clutch which is preloaded to a predetermined torque and this assembly is commonly used with the non-frangible fasteners to provide a control on the tightening torque applied to the fasteners. It is not needed when the tool is to be used with frangible fastener systems.

The torque control assembly is attached to the tool head assembly 21. This head assembly has a housing 24 which contains a plurality of gears that provide a gear train with the appropriate speed reduction characteristic for the particular tool. At its upper end, the head assembly 22 supports a socket assembly 24. A number of interchangeable socket assemblies can be used to provide a variable extension from the face 28 of the head assembly housing 24. The particular socket assembly illustrated is flush with this plate and receives in its socket 30, the wrenching ring 32 of a frangible fastener 34. The socket assembly is also illustrated with the key 36 of the invention restrained in the core of the holder member 38. The workpiece is generally indicated at 40 and comprises two members to be retained by a bolt fastener 42 and a threaded collar fastener 44 of the frangible fastener unit.

Figure 2:
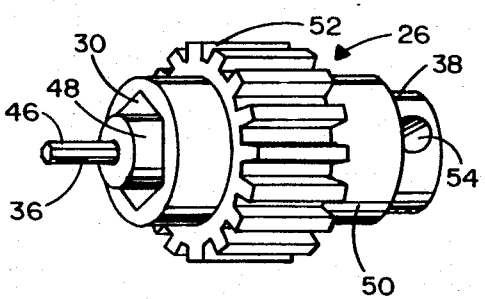
FIG. 2 is a perspective view of the socket subassembly of the wrenching tool.

Referring now to FIG. 2, there is illustrated the socket assembly 26 removed from the head assembly 22. The socket assembly comprises three major parts; the key 36 having one or more flats 46 which is received within a broached keyway concentric in the core 48 of the holder member 38. The holder member 38 is slideably received within a through bore of the outer, driven member 50 which has a plurality of sprocket gear teeth 52 about its periphery. These gear teeth 52 engage with gears within the head assembly 22. The forward end of the driven member 50 has a socket 30 for receiving the wrenching ring 32 previously mentioned with regard to FIG. 1. The holder member has a transverse bore 54 which receives a spring retainer that restrains this member against rotation while permitting its relative axial displacement within the driven member 50.

Figure 3:
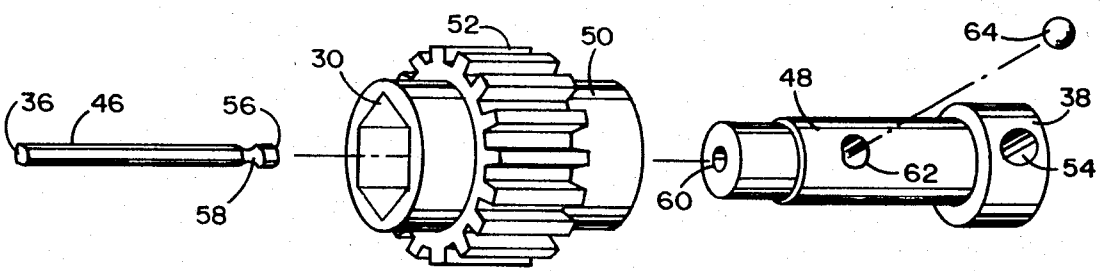
FIG. 3 is an exploded perspective view of the socket drive subassembly.

Referring now to FIG. 3, the socket assembly is shown in exploded view. As there illustrated, key 36 has flats 46 coextensive its length with one end chamfered at 56 and with a peripheral groove 58 adjacent the chamfered end. The aforementioned sprocket gear teeth 52 preferably are integral with the driven member 50, and this member has a socket end 30 which is in communication with a through bore, not shown, having a sufficient inside diameter to slideably receive the central core 48 of the holder member 38. The holder member 38 has a center bore 60 which is broached to provide flatted surfaces which mate the flatted surfaces 46 of key 36. Intermediate its length, the holder member has a cross bore 62 which intersects the longitudinal center bore 60. This cross bore 62 is of sufficient diameter to receive the ball 64 which serves as a detent, cooperatively engaging the peripheral groove 58 of the key 36.

Figure 4:
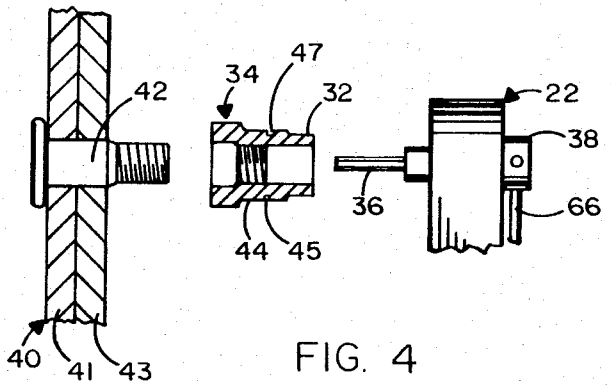
FIG. 4 is an elevational sectional view of a fastener system and the wrenching tool.

Referring now to FIGS. 4–7, the use of the invention will be briefly described. As shown in FIG. 4, the workpiece 40 comprises plates 41 and 43 which are to be fastened and, for this purpose, have aligned bores which receive the shank of a bolt 42. Bolt 42 is used in combination with a frangible fastener 34 having an internally threaded collar 44 on one end, and a wrenching ring 32 on its opposite end, separated by an annular notched section 45 which has a groove 47 of a predetermined depth to provide a predetermined breakaway torque for separating the wrenching ring from the collar 44. The head assembly 22 of the wrenching tool of the invention is shown with the key 36 of the invention retained in the holder member 38 which is restrained against rotation by spring 66.

Figure 6:
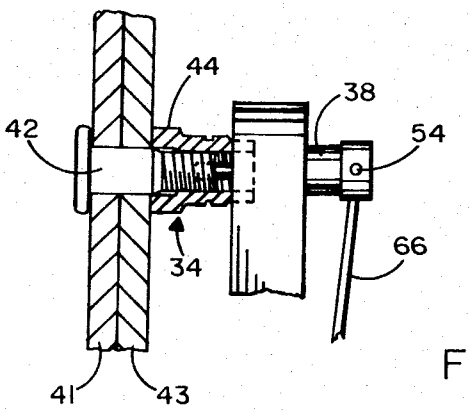
FIG. 6 is an elevational sectional view illustrating the torquing of the fastener system.
Figure 7:
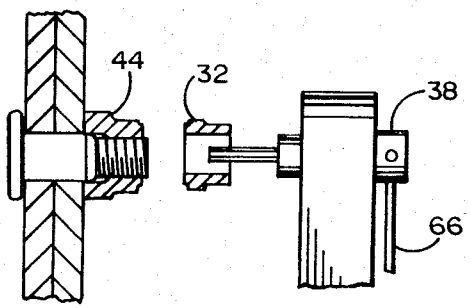
FIG. 7 is an elevational sectional view illustrating the separation of the wrenching collar and the wrenching tool.
Figure 5:
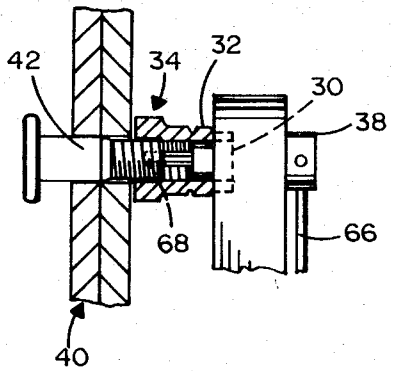
FIG. 5 is a sectional elevational view illustrating the application of the nut to the bolt of the fastener system.

Referring to FIG. 5, the fastener 34 is shown applied on bolt 42, in a conventional loose fit. The bolt 42 has a center keyway 68 with mating flats to receive the end of key 36 and the wrenching collar 32 is placed in the socket 30 of the wrenching tool. In this position, the work is to be secured by actuation of the wrenching tool which advances the collar 44 on the bolt 42. This operation is illustrated in FIG. 6 where the locking collar 44 is advanced on bolt 42 with the bolt 42 drawn into tension, restraining plates 41 and 43. As the locking collar 44 is advanced on bolt 42, the holder member 38 is slideably displaced in the wrenching tool, reaching the position shown in FIG. 6. Throughout this movement, the holder member 38 is retained stationary by the spring 66 which has a bent end received in the through bore 54 in the end of holder member 38. The continued application of torque to the frangible fastener 34 results in failure of its notched center section and separation of the wrenching collar 32 from the fastener collar 44 which remains in place, securely locking the fastener. When the wrenching tool is retracted in the manner shown in FIG. 7, the spring 66 returns the holder member 38 to its normal position, ejecting the wrenching ring 32 from the internal socket 30 of the wrenching tool. The device will also work with non-frangible fastener systems which do not release a separate wrenching collar to the tool.

Figure 8:
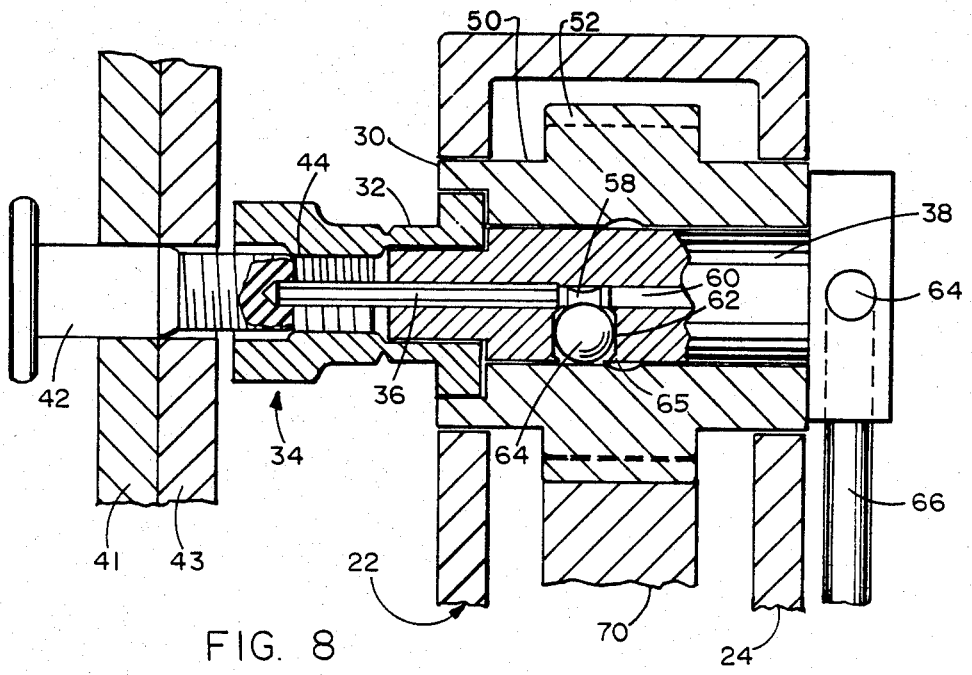
FIG. 8 is an enlarged sectional view of FIG. 5.

Referring now to FIG. 8, the wrenching tool and fastener system is shown in greater detail. As there illustrated, the bolt 42 is shown in a loose fit extending through plates 41 and 43 and with its threaded end entering into the internally threaded fastener collar 44. The wrenching ring 32 at the opposite end of the frangible fastener 34 is shown engaged in the socket 30 of the driven member 50. The holder unit 38 is shown in its fully extended position and the key 36 is shown restrained by the ball 64 that is received in the cross bore 62 and projects into the central bore 60 of the holder member 38. Preferably, ball 64 is captured in cross bore 62 by staked means such as a distal annular lip 65 on the inside wall of cross bore 62. The key 36 is secured by ball 64 which seats in the peripheral groove 58 of the key. The ball 64 is held in this position by the driven member 50, surrounding the holder member 38. The driven member 50 is illustrated with its sprocket gear teeth 52 meshed with the drive teeth of a driving sprocket gear 70, contained within the housing 24 of the head assembly 22. The holder member 38 is retained stationary in this assembly by the end of spring 66 which extends into the cross bore 64, all as previously described.

Figure 9:
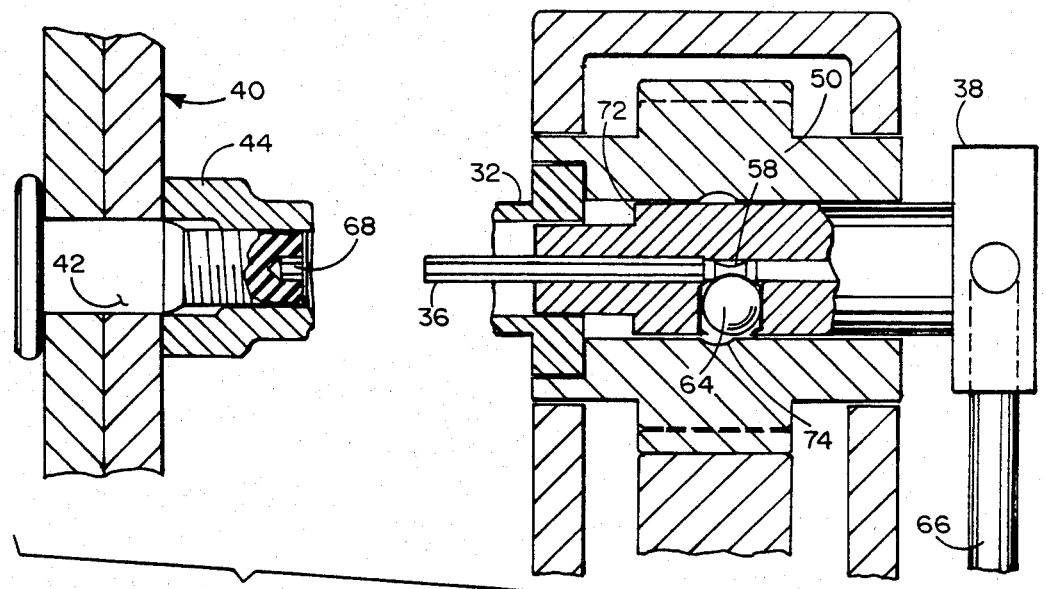
FIG. 9 is an elevational view illustrating the tool and wrenching collar separated from the fastener system.

FIG. 9 illustrates the wrenching tool immediately upon separation of the frangible wrenching ring 32 from the fastener collar 44. This occurs when the fastening collar is advanced sufficiently on bolt 42 to achieve a predetermined tension in bolt 42, compressing the workpiece 40. The wrenching tool is retracted from the work, extracting the key 36 from the broached keyway 68 in the end of bolt 42. As the wrenching tool is retracted, spring 66 resiliently biases the holder member 38 towards its extended position, advancing this unit until the shoulder 72 abuts the wrenching ring 32 and ejects this ring from the socket.

As the holder member 38 moves to advance the ball 64 past the alignment with the annular groove 74 of the driven member 50, the ball 64 remains in position securing the key 36 since this alignment is only a transient condition and insufficient time is provided for ball 64 to retract from its illustrated position engaging the groove 58 of key 36.

Figure 10:
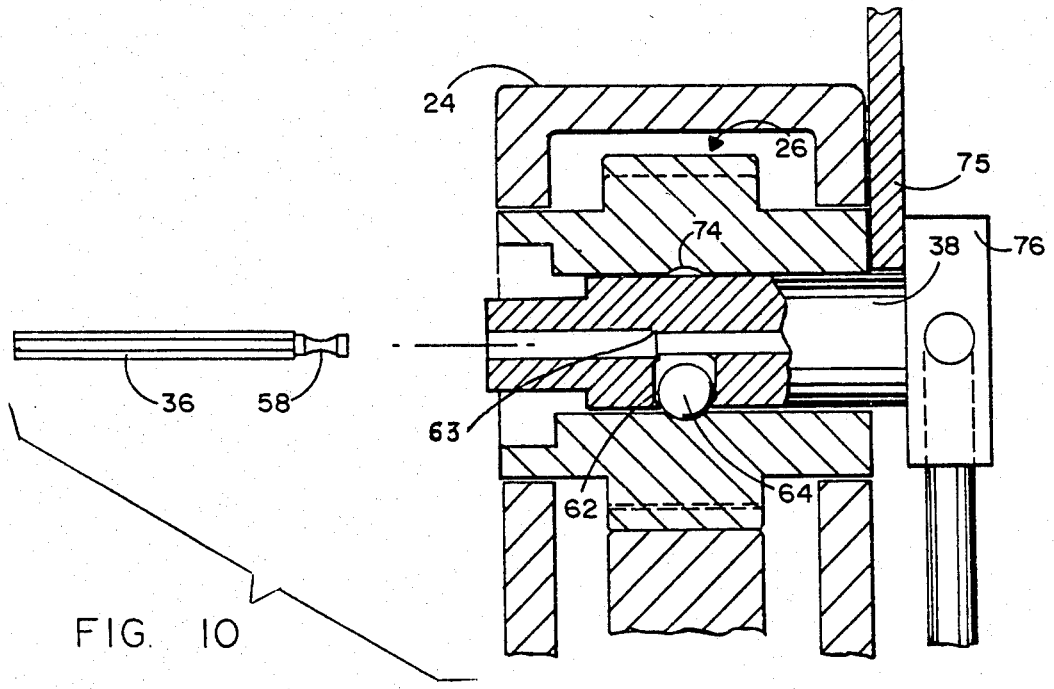
FIG. 10 illustrates the retraction of the key from the wrenching tool of the invention.

The key 36 can be readily extracted from the socket assembly 26 in the manner shown in FIG. 10. As there illustrated, the annular groove 74 is positioned in exact alignment with the cross bore 62 of the holder member 38, permitting ball 64 to move laterally, retracting the ball from its engagement with groove 58 in the end of key 36. This frees key 36 for extraction from the assembly, as shown in FIG. 10. With this key removed, shoulder 63 is visible in through bore 60 which provides an abutment stop for key 36. The annular groove 74 can be maintained in the alignment with cross bore 62 by placing a spacer block 75 between the back of housing 24 of the head assembly and the head 76 of the holder member 38. If desired, the spacer can be permanently attached to the tool by a pivotal attachment to permit it to be swung into the illustrated position when needed and moved to one side when the tool is in use.

Figure 11:
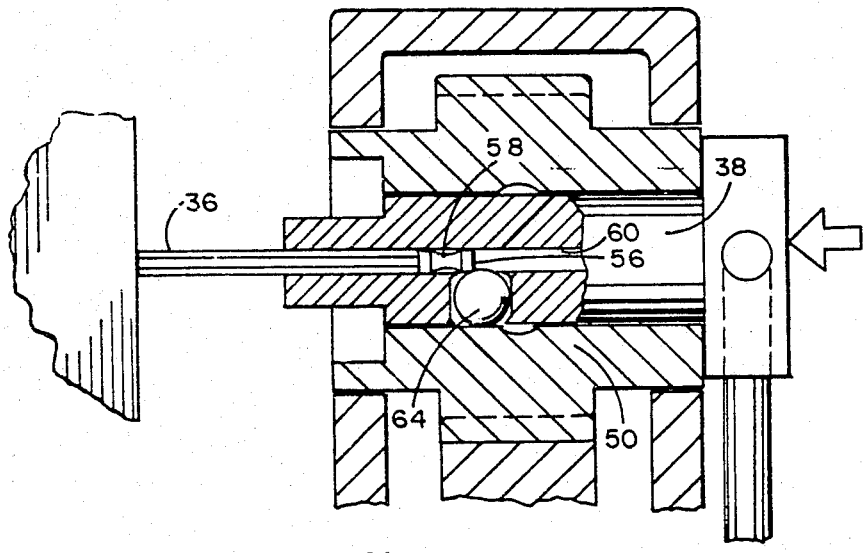
FIG. 11 is an elevational view illustrating insertion of the key into the holder member of the wrenching tool.

One feature of the invention is that the key 36 can be set in the socket assembly into the retained position within holder 38 by forcefully advancing the key 36 in the manner illustrated in FIG. 11. In this application, the ball 64 is in its inwardly displaced position, restrained therein by the driven member 50. The inboard end of key 36 encounters the ball and its inward movement is interfered with by the ball. The key, however, has adequate resiliency to flex sufficiently to permit its head end to advance past the ball 64. For this purpose, the head end of key 36 is chamfered as shown at 56 at an angle of 10 to about 65 degrees, preferably of 45 degrees, with its longitudinal axis, and the restraining peripheral groove 58 is located within a distance from 0.2 to about 0.5 times the diameter of ball 64. Additional, there should be a slight tolerance in the fit beteen the key and its receiving bore 60. Since this provides a facile and fast manner for seating the key 36 in the socket assembly, it constitutes a preferred embodiment of the key 36 for use in the invention.

Figure 12:
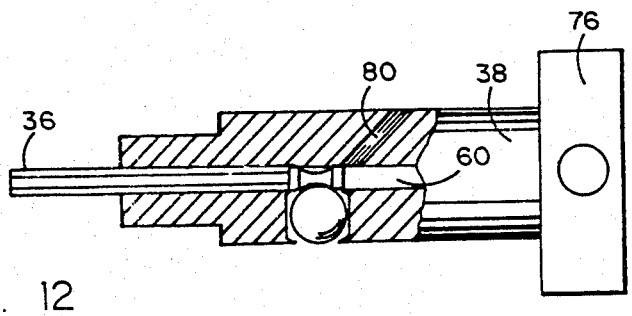
FIG. 12 illustrates an alternate construction of the key holder member of the invention.

The bore 60 in the center of holder 38 is preferably coextensive the length of holder member 38 thereby permitting access through the head 76 of holder member 38 thereby permitting one to insert a pin to forcefully eject key 36 should the latter become jammed in the holder member 38. Alternatively, an angular cross bore 80 can be provided in this holder member 38, intersecting the central bore 60 in the manner illustrated in FIG. 12.

The invention as thus described provides a number of advantages over the conventionally employed unit having a key which is retained in the holder member by set screws and the like. Firstly, the key can be very quickly inserted or extracted from the holder member without requiring its disassembly or removal of a set screw. This is important particularly when switching the tool between interference and loose fit applications, as is frequently required. A broken key segment within the holder 38 can be readily removed by the alignment of the annular groove 74 with the cross bore 62 in holder 38 which permits the ball 64 to release the key and the key will then fall from the holder 38. In the event that the key is jammed in this holder, a pin can be advanced through the continuous through bore 60 from the head end 38 of the assembly. Also, a frequent occurrence is the jamming of the key 36 in the broached keyway 68 of the fastener 42. When this has occurred in the past, the entire wrenching tool is captured and retained until the key 36 can be freed or broken to permit removal of the wrenching tool. With the key and detent ball of this invention, the wrenching tool can be readily freed from the fastener system by simply moving the holder member 38 into the key disengagement position and, if necessary, using a spacer block such as 75 for this purpose. Once the tool is aligned in this manner, it can readily be removed, leaving the jammed key 36 in the bolt 42 for subsequent extraction.

While the invention has been illustrated with reference to the presently preferred fastener system, it can, of course, be used with any other fastener systems employed in loose fits where it is necessary to immobilize a bolt while advancing a threaded collar or nut on the bolt.

The invention has been illustrated with reference to the presently preferred embodiment. It is not intended that the invention be unduly limited by this disclosure and illustration of the presently preferred embodiment. Instead, it is intended that the invention be defined by the means, and their obvious equivalents, set forth in the following claims.

What is claimed is:

1. A rotational wrenching tool which comprises a driven member having a distal socket and a central through bore and slideably received therein a rotationally stationary holder member having a central bore extending from one end thereof, and a central key member received within said central bore of said holder member, and positive means to axially restrain said key member in said holder member comprising (a) a cross bore in said holder member intersecting said central bore;

(b) a ball received within said cross bore and having a diameter greater than the annular thickness of said holder member surrounding said central bore;

(c) an annular groove in said driven member about said central through bore, intermediate the length of said driven member to provide a lateral outward recess for said ball;

(d) a distal groove on the inboard end of said key to provide a lateral inward recess for said ball;

(e) a spring biasing said holder member towards said one end having said central bore; and (f) abutment stop means on said holder and cooperating means on said key to limit the axial movement of said key into said central bore when the said outer annular groove is opposite said ball;

whereby said key is axially restrained in said holder when said ball is seated in said distal groove of said key and can be released therefrom by aligning said cross bore with said annular groove, whereby said ball is freed for lateral outward displacement.

2. The improvement of claim 1 wherein said cross bore has a distal annular lip on its inside surface to retain said ball therein.

3. The improvement of claim 1 wherein said key member has a plurality of longitudinal flats and said central bore has a mating cross section.

4. The improvement of claim 1 wherein said key member has a distal chamfer.

5. The improvement of claim 4 wherein said distal groove is located a distance from the end of said pin which is between 0.2 to 0.5 ball diameter.

6. The improvement of claim 1 wherein said driven member has integral gear teeth about its periphery.

7. The improvement of claim 6 wherein said holder member is rotationally restrained by a spring retainer distally engaged therewith.

8. The improvement of claim 1 in combination with a bolt having a central keyway receiving said key member and a nut with a collar end threadably engaged on said bolt and an opposite, wrenching ring end received in said socket member.

9. The combination of claim 8 wherein said collar is a frangible fastener nut having a notched section between said collar and wrenching ring ends.

10. The tool of claim 1 including spacer block means on said wrenching tool and cooperative with said holder to limit its sliding movement in said through bore of said outer member when said cross bore of said holder is aligned with said inner annular groove of said outer member to permit said ball to be displaced from said outer annular groove of said key and free said key for retraction from said receiving bore.

11. The combination of interlocking members comprising:

(a) an outer member having a through bore with an inner annular groove on the inside wall of said through bore;

(b) a holder member slidably received in said through bore and having a longitudinal receiving bore in one end thereof, with a ball receptacle intersecting said receiving bore;

(c) a ball member received in said receptacle and having a diameter slightly greater than the thickness of said receptacle;

(d) a key member removably mounted in said receiving bore with a groove in its end mounted in said receiving bore;

(e) resilient means biasing said holder member towards said one end having said central bore; and (f) abutment stop means on said holder and cooperating means on said key to limit the axial movement of said key into said central bore when said groove is opposite said ball.

12. The combination of interlocking members of claim 11 wherein said groove in the end of said key member is an annular groove about the end of said key member.

13. The combination of interlocking members of claim 12 wherein said key member has at least one longitudinal flat and said receiving bore has a mating cross section, thereby rotationally indexing said key and holder members.

14. The combination of interlocking members of claim 13 wherein said outer member has a distal socket and said holder and receiving bore are coaxial therewith.

15. The combination of interlocking members of claim 14 wherein said outer and holder members are a wrenching tool subassembly and said outer member bears gear teeth for engagement by a driving member.

16. The combination of interlocking members of claim 11 wherein said abutment stop means is an internal shoulder in said central bore.

17. The combination of interlocking members of claim 16 wherein said cooperating means on said key is an external shoulder which abuts said internal shoulder in said central bore.

18. The combination of interlocking members of claim 11 including spacer block means on said wrenching tool subassembly and cooperative with said holder to limit its sliding movement in said through bore of said outer member when said receptacle of said holder is aligned with said inner annular groove of said outer member to permit said ball to be displaced from said outer annular groove of said key and free said key for retraction from said receiving bore.

19. The combination of interlocking members of claim 18 wherein said groove in the end of said key member is an annular groove about the end of said key member.

20. The combination of interlocking members of claim 19 wherein said key member has at least one longitudinal flat and said receiving bore has a mating cross section, thereby rotationally indexing said key and holder members.

21. The combination of interlocking members of claim 20 wherein said outer member has a distal socket and said holder and receiving bore are coaxial therewith.

22. The combination of interlocking members of claim 21 wherein said outer and holder members are a wrenching tool subassembly and said outer member bears gear teeth for engagement by a driving member.

23. The combination of interlocking members of claim 18 wherein said abutment stop means is an internal shoulder in said central bore.

24. The combination of interlocking members of claim 23 wherein said cooperating means on said key is an external shoulder which abuts said internal shoulder in said central bore.

* * * * *